United States Patent [19]

Kaminishi

[11] Patent Number: 4,470,040

[45] Date of Patent: Sep. 4, 1984

[54] MICROVIBRATION DETECTOR USING A SINGLE PIEZOELECTRIC ELEMENT AS BOTH SENSOR AND ALARM GENERATOR

[75] Inventor: Tokishi Kaminishi, Inuyama, Japan

[73] Assignees: Agency of Industrial Science & Technology; Ministry of International Trade & Industry, both of Tokyo, Japan

[21] Appl. No.: 317,800

[22] Filed: Nov. 4, 1981

[30] Foreign Application Priority Data

Nov. 12, 1980 [JP] Japan ..... 55-159311

[51] Int. Cl.[3] ..... G08B 13/00

[52] U.S. Cl. ..... 340/566; 310/311; 331/58; 331/65; 340/683

[58] Field of Search ..... 340/566, 683; 310/316, 310/314, 311; 331/58, 65

[56] References Cited

U.S. PATENT DOCUMENTS

| | | | |
|---|---|---|---|
| 2,524,579 | 10/1950 | Taylor | 340/683 |
| 3,665,259 | 5/1972 | Brailsford | 340/566 |
| 3,670,301 | 6/1972 | Douglas | 340/566 |
| 3,750,127 | 7/1973 | Ayers et al. | 340/566 |
| 3,863,250 | 1/1975 | McCluskey, Jr. | 340/566 |
| 4,170,769 | 10/1979 | Morris et al. | 340/566 |

*Primary Examiner*—Glen R. Swann, III

*Attorney, Agent, or Firm*—Kurt Kelman

[57] ABSTRACT

An alarm device comprises a blocking oscillator circuit composed of a transformer and a transistor and a sound emitter using a piezoelectric effect exhibiting element and interposed between one end of the secondary coil of the transformer and a power source, with the other end of the secondary coil connected to the base of the transistor. When the sound emitter receives a slight vibration, it generates an electromotive force, which is applied to the base of the transistor. Consequently, the blocking oscillation circuit oscillates and causes the sound emitter to issue an alarm.

6 Claims, 5 Drawing Figures

MICROVIBRATION DETECTOR USING A SINGLE PIEZOELECTRIC ELEMENT AS BOTH SENSOR AND ALARM GENERATOR

BACKGROUND OF THE INVENTION

This invention relates to a microvibration detector using a single piezoelectric element as both sensor and alarm generator. More particularly, this invention relates to a microvibration detection and alarm device of a simple circuit configuration wherein a sound emitter using a single element having a piezoelectric effect serves concurrently as a vibration detector and a sound emitter.

A number of types of sensors designed to detect vibration of various kinds including sound and dynamic pressure and to trigger a warning or the like have been proposed to date. In sensors which detect vibrations electrically, the introduction of piezoelectric elements has led to improved sensitivity and performance and reduced sensor size. These sensors utilize, as their input, the electromotive force which is generated by a piezoelectric element when it is subjected to vibration. Although alarm devices employing such sensors are available in various designs, all operate on the same basic principle. An electric signal from the piezoelectric element is amplified and the resultant amplified signal is utilized to actuate a sound emitter such as a speaker or a buzzer.

Increased sensitivity, reduced size, and lower power consumption have been realized by using piezoelectric elements at both the input and output stages of the sensors. As is plain from the foregoing description, however, the alarms of this type require an amplifier, an oscillator, and a sound emitter in addition to a vibration sensor. Further miniaturization of these alarms by the use of smaller and simpler circuits has proved difficult. Efforts to attain the desired reduction in size, cost and power consumption by omitting circuit parts sensor, or even sound emitters have proved impracticable.

SUMMARY OF THE INVENTION

The object of this invention is to provide a simple, compact and power-efficient microvibration detector using a single piezoelectric element as both sensor and alarm generator of high sensitivity in which a single element having a piezoelectric effect simultaneously provides both vibration-detecting function and alarm-issuing function and a single circuit provides both amplification and oscillation functions.

To accomplish the object described above according to this invention, there is provided a microvibration detector using a single piezoelectric element as both sensor and alarm generator which comprises a blocking oscillator circuit incorporating a transformer and a transistor connected to the primary coil of the transformer, a sound emitter using an element having a piezoelectric effect and interposed between one end of the secondary coil of the transformer and the power source, and a diode interposed between the base of the transistor and the negative electrode of the power source.

When the sound emitter receives a vibration, it generates a voltage owing to the piezoelectric effect of the elements, imparts the voltage as a signal to the base of the transistor and consequently causes the blocking oscillator circuit to oscillate and actuates the sound emitter connected to the secondary coil of the transformer, thus issuing an alarm.

In the circuit of the construction described above, the sound emitter remains in its actuated state unless the device is isolated from its power source. By attaching a condenser of a suitable capacity to the base side of the transistor, the transistor can be turned off and the alarm stopped after it has sounded for a prescribed time. Further by providing this condenser with a discharge circuit, the sound emitter can be quickly reset to its standby state after the alarm is stopped.

The other objects and characteristics of this invention will become apparent from the further disclosure to be made below with reference to the accompanying drawings.

DESCRIPTION OF THE PREFERRED EMBODIMENTS

This invention relates to a microvibration detector using a single piezoelectric element as both sensor and alarm generator of simple construction, which operates with high sensitivity in response to even a faint vibration such as of dynamic pressure or sound.

Figure 1:
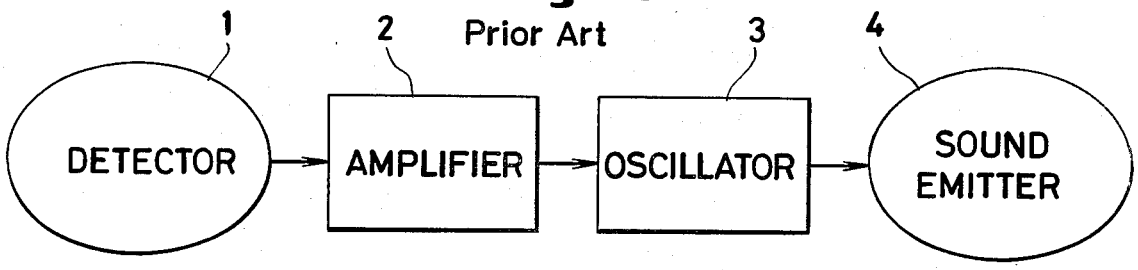
Fig. 1 Prior Art
FIG. 1 is a block diagram of the conventional vibration detection device.

FIG. 1 is a block diagram illustrating the general construction of a known vibration detecting device. This device comprises a detector 1 for sensing vibration (i.e. a so-called vibration sensor such as a microphone), an amplifier 2, an oscillator 3, and a sound emitter 4 (such as a speaker or buzzer). Conventional devices of this type are constituted of many components arranged in complicated circuits.

The alarm device of the present invention is characterized by enabling one element to serve concurrently as a vibration detector and a sound emitter and further enabling a single unit to serve concurrently as an amplifier and an oscillator, permitting considerable circuit simplification and ensuring sounding of an amply loud alarm with little electric power (1 mW or less). The first embodiment of this device is illustrated in FIG. 2.

Figure 2:
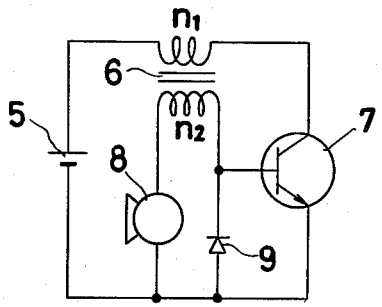
FIG. 2 is a circuit diagram of a first embodiment of the microvibration detector using a single piezoelectric element as both sensor and alarm generator according to the present invention.

FIG. 2 is a circuit diagram of the microvibration detector using a single piezoelectric element as both sensor and alarm generator according to the present invention. The collector of an npn-type transistor 7 is connected via the primary coil $n_1$ of a transformer 6 to the positive electrode side of a DC power source 5, and the emitter of the transistor 7 is connected to the negative electrode side of the power source 5. A sound emitter 8 adapted to function concurrently as a vibration detector and a sound emitter is connected to one end of the secondary coil $n_2$ of the transformer, and the base of the transistor 7 and a diode 9 are connected to the other end of the secondary coil $n_2$. The remaining terminal of the sound emitter 8 can be connected to the positive electrode side or the negative electrode side of the power source 5, whichever is more convenient. In the illustrated embodiment, connection is made to the negative electrode side.

As elements capable of simultaneously functioning as a vibration detector and a sound emitter, there can be used elements having a piezoelectric effect (hereinafter referred to as "piezoelectric effect exhibiting elements"), such as crystal speakers using a piezoelectric element or electret speakers using an electret having a piezoelectric effect. Particularly the electret speaker functions effectively with small current because it has high impedance and can be incorporated as a high-impedance load on the base side of a transistor. Besides, the primary coil and the secondary coil of the transformer are inversely coupled. A coil ratio in the range of about 1:5 to 1:20 is suitable. The vibration detection sensitivity increases with increasing coil ratio. Optionally, a pnp-type transistor can be used in the device of this invention by slightly changing the wiring of the circuit.

The alarm device is constantly connected to its power source 5. Despite this constant power source connection, since the circuit of this device contains no element for actuating the transistor 7, this transistor 7 remains nonconductive during normal service of the device and, therefore, is prevented from issuing an alarm signal or consuming power.

When a vibration acts on the sound emitter 8, the piezoelectric effect exhibiting element of this emitter is actuated to generate an AC voltage between its opposite terminals. Consequently, a slight current passes through the secondary coil $n_2$ of the transformer 6 to the base of the transistor 7 and this base current is fed back to the base of the transistor because of the amplifying action of the transistor 7 and the inversely coupling characteristic of the transformer 6. Thus, the circuit is put into an oscillating state. In this case, the oscillation is sustained because the base of the transistor 7 is held at a slight positive potential by the diode 9. The oscillation voltage generated in the secondary coil $n_2$ of the transformer 6 is applied to the sound emitter 8 to vibrate the piezoelectric effect exhibiting element and issue an alarm. The electric signal generated by this vibration is again applied to the base of the transistor 7. The vibration, therefore, continues until the power source is exhausted. Once the device detects a vibration, it continues to issue the alarm, thus fulfilling its purpose. The alarm can be stopped by momentarily opening of the circuit, for example by breaking the power source connection momentarily by means of a switch (not shown). Once the vibration is stopped, the device assumes its original standby status and stably remains in that state until another vibration occurs. The electric power consumed when the circuit is in oscillation is a mere 0.5 to 0.7 mW. Therefore a single penlight battery is enough to keep the device in service for a long time.

Figure 3:
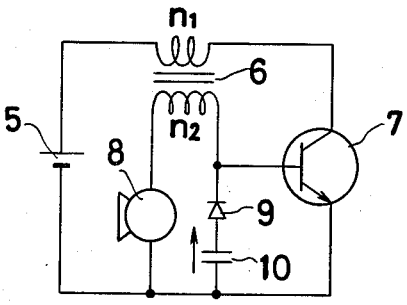
FIG. 3 is a circuit diagram of a second embodiment of the device according to the present invention.

Now, a second embodiment of this invention will be described with reference to the diagram of FIG. 3.

The construction and operation of this second embodiment are virtually the same as those of the first embodiment described above. In the first embodiment, however, once the device detects a vibration and starts issuing an alarm, it continues to issue this alarm until someone stops it. By contrast, in the second embodiment, the alarm which the device issues on detecting a vibration is permitted to continue only for a definite length of time. The device is constructed so that the alarm will be automatically stopped after elapse of this prescribed time.

Compared with the circuit configuration of the first embodiment, that of the second embodiment differs in that a condenser 10 is connected serially with the diode 9 which is connected to the base of the transistor 7. This condenser 10 fulfills a unique function in the circuit. When a vibration affects the sound emitter 8, the circuit is put into oscillation. At the start of this oscillation the condenser 10 is under no charge. The circuit including the sound emitter 8, the diode 9, and the condenser 10 can be regarded as constituting a rectifying and smoothing circuit having the secondary coil $n_2$ of the transformer 6 as its AC power source. Therefore, the oscillation current in the rectifying direction of the diode 9 begins to charge the condenser 10 in the direction of the arrow shown in FIG. 3. As a result, the base of the transistor 7 assumes a negative DC potential relative to the emitter of the transistor. Since the oscillation level is amply high, however, flow of ample base current still continues to enable the device to continue issuing the alarm. As oscillation continues, the charging of the condenser 10 gradually proceeds to a point where base current can no longer flow. At a certain point, therefore, the oscillation suddenly terminates. At this time the condenser 10 retains its charge. Besides, as there is nothing to induce oscillation, the alarm discontinues. Thus, the device has fulfilled its purpose.

As is evident from the operation described above, the duration of the alarm issued by the sound emitter is proportional to the capacity of the condenser 10. This means that the duration of the alarm can be freely selected by suitably changing the capacity of the condenser 10. Where the alarm is desired to be stopped before it is automatically stopped by the device, this can be effected by momentarily opening of the circuit as by breaking the power source connection by means of a switch, as in the device of the first embodiment.

In both the first and second embodiments described above, oscillation begins and the device issues an alarm whenever the transistor is actuated and the cause of actuation need not necessarily be vibration. The device, therefore, can be made to issue an alarm by applying a positive pulse signal to the base of the transistor 7, for example. When the elements making up the circuit described above are encased in a suitable container, they can be conveniently carried around or readily mounted on various kinds of objects and applied to a wide range of uses.

Now, a typical use for the microvibration detector using a single piezoelectric element as both sensor and alarm generator of this invention will be described.

Figure 4:
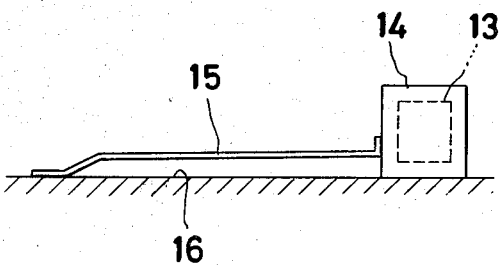
FIG. 4 is an explanatory view illustrating one use to which the device of the present invention is put.

FIG. 4 is a schematic diagram illustrating an microvibration detector using a single piezoelectric element as both sensor and alarm generator 13 according to this invention as encased in a container 14 made of a suitable hard material and installed near the entrance of a room for the purpose of sensing the passage of persons through the entrance. In this case, the device of either the first or the second embodiment described above can be effectively adopted as the alarm device 13.

On the floor 16 at the entrance, a thin plate 15 of proper length having one end thereof fastened to the floor 16 is disposed at a slight distance from the surface of the floor, with the other end kept in light touch with the container 14 of the alarm device 13. The upper side of this thin plate 15 may be covered with a suitable floor cushion when desired. When a person passing through the entrance steps on this thin plate 15, the vibration produced in the thin plate is transmitted through the container 14 to the alarm device 13. On sensing the slight vibration thus conveyed, the device issues an alarm indicating the passage of the person through the entrance. By use of this device, therefore, unauthorized persons can be kept from entering a room.

When the device is installed in the same manner on doors, windows, or showcases, for example, it can serve as a burglar alarm.

Figure 5:
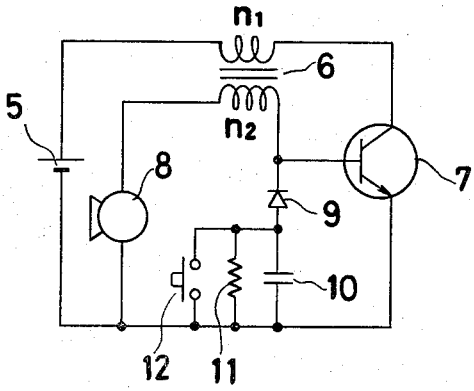
FIG. 5 is a circuit diagram of a third embodiment of the device according to the present invention.

A typical circuit diagram of the microvibration detector using a single piezoelectric element as both sensor and alarm generator particularly suitable for such practical uses is illustrated in FIG. 5. In FIG. 5, a resistor 11 of high ohmic value and a pushbutton switch 12 are additionally connected in parallel to the condenser 10. When the alarm is issued and then stopped upon the elapse of the prescribed time, the condenser 10 immediately starts to discharge via the resistor 11 and consequently permits automatic resumption of the base potential. Substantially complete discharging of the condenser 10 requires a time which is proportional to the product of the capacity of the condenser multiplied by the resistance of the resistor. The time so required is 400 to 500 seconds where the capacity of the condenser is 100 $\mu$F and the value of the resistance is 1 M$\Omega$, for example. If the device is required to be immediately readied for next detection, rapid discharge of the condenser 10 can be accomplished by momentarily depressing the pushbutton switch 12.

To cite a working example, an microvibration detector using a single piezoelectric element as both sensor and alarm generator was produced by selecting an electret speaker (impedance about 300 K$\Omega$) as the unit concurrently serving as a vibration detector and a sound emitter, a transformer having a primary impedance of 1 K$\Omega$, a secondary impedance of 100 K$\Omega$, and a coil ratio of 1:10, a transistor of npn-type, a condenser having a capacity of 100 $\mu$F, a resistor having a resistance of 1 M$\Omega$, and one penlight battery (1.5 V) as the power source, connecting the elements so as to form a circuit as illustrated in FIG. 5, and encasing them in a hard plastic container.

When this microvibration detector using a single piezoelectric element as both sensor and alarm generator was set on a desk and was lightly tapped on the side with the bottom of a pencil, it started producing an alarm. The alarm was a light continuous sound about 2 KHz in frequency. The sound volume was such that it could be clearly perceived at a distance of about 10 m. The sound lasted for about 30 seconds. When the alarm device was subjected to vibration after the alarm had been stopped and before the condenser had completed its discharge, the device again started producing the alarm. In this case, however, the duration of the alarm was shortened by the degree of the discharge of the condenser. While the alarm sounded, the current to the device was 0.5 mA at first and 0.2 mA immediately before the end, averaging at 0.4 mA. Thus, the average power consumption was only about 0.6 mW. While the device was on standby, the current to the device was less than 0.01 $\mu$A. Although the exact amount of current was dependent on the ambient temperature, there was no particular need for providing a switch on the power source.

The device can fulfill its function even if the voltage of the power source is lowered to the level of 0.5 V though the volume of the alarm may fall off to a slight extent. Even with just one penlight battery, therefore, the device can be effectively used for a long time.

The ability of the device to sense vibration depends to a high degree on the kind of sound emitter or the frequency characteristics of the sound emitter and depends more or less upon the characteristics of the transistor and the primary and secondary coil ratio of the transformer. Generally, the device is highly sensitive to vibrations and sounds of frequencies falling in the neighborhood of 2 KHz. When the circuit elements making up the alarm device of this invention are encased in a container made of a metal or some other hard substance, touching the container even very lightly with a hard object will cause the alarm to go off.

As described in detail above, the microvibration detector using a single piezoelectric element as both sensor and alarm generator of this invention permits notable circuit simplification because it enables the vibration-detecting function to be concurrently fulfilled by the same component. Although the prototype alarm device mentioned above had exterior dimensions of about 60 mm in width, 70 mm in length and 35 mm in height, it could have been further reduced in size if required. The present invention, therefore, provides an alarm device which enjoys low power consumption, low cost, and high operational reliability. It is expected to find extensive utility as a device for safeguarding facilities and installations.

What is claimed is:

1. A microvibration detector using a single piezoelectric element as both sensor and alarm generator, comprising in combination a blocking oscillator circuit composed of a transformer provided with a primary coil and a secondary coil and a transistor having the collector thereof connected to one end of the primary coil of said transformer and the base thereof connected to one end of said secondary coil, a power source having a first electrode connected to the other end of the primary coil of said transformer and a second electrode connected to the emitter of said transistor, a sound emitter using an element having a piezoelectric effect and connected at one end thereof to the other end of the secondary coil of said transformer and at the other end thereof to the second electrode of said power source, and a diode connected at one end thereof to the base of said transistor and at the other end thereof to the second electrode of said power source.

2. The device according to claim 1, which further comprises a condenser interposed between said diode and the second electrode of said power source.

3. The device according to claim 2, which further comprises a resistor and a switch disposed in parallel to said condenser.

4. The device according to claim 1, wherein the ratio of the primary coil and the secondary coil of said transformer falls in the range of 1:5 to 1:20.

5. The device according to claim 1, wherein said sound emitter is an electret speaker.

6. The device according to claim 1, wherein the positive electrode of said power source is connected to said other end of the primary coil of said transformer, said one end of the primary coil is connected to the collector of the transistor, said transistor being an npn type transistor, and the emitter of said transistor is connected to the negative electrode of said power source.

* * * * *